US005206914A

United States Patent [19]

Fortney et al.

[11] Patent Number: 5,206,914

[45] Date of Patent: Apr. 27, 1993

[54] ELECTROSTATIC ACOUSTIC TRANSDUCER HAVING EXTREMELY THIN DIAPHRAGM SUBSTRATE

[75] Inventors: Neil K. Fortney, Madison; Manfred W. Suhr, Oregon, both of Wis.

[73] Assignee: Koss Corporation, Milwaukee, Wis.

[21] Appl. No.: 738,826

[22] Filed: Aug. 1, 1991

Related U.S. Application Data

[63] Continuation-in-part of Ser. No. 461,197, Jan. 5, 1990.

[51] Int. Cl.[5] ..... H04R 25/00

[52] U.S. Cl. ..... 381/191; 381/113; 381/183; 29/594

[58] Field of Search ..... 381/191, 183, 113, 116, 381/170, 190, 173; 29/594, 609.1

[56] References Cited

U.S. PATENT DOCUMENTS

| | | | |
|---|---|---|---|
| 3,632,903 | 1/1972 | Lange, Jr. | 381/24 |
| 4,049,859 | 9/1977 | Yoshikawa et al. | 428/172 |
| 4,250,415 | 2/1981 | Lewiner et al. | 381/191 |
| 4,533,794 | 8/1985 | Beveridge | 381/113 |
| 4,820,952 | 4/1989 | Lee | 381/190 |

OTHER PUBLICATIONS

"Modern Plastics Encyclopedia", vol. 46: No. 10A, p. 154, Oct. 1969.

"The Infrared Handbook", William L. Wolfe and George J. Zissis, Revised Edition 1985, pp. 1-15, 7-16, 7-17, 7-39, 7-81.

*Primary Examiner*—Jin F. Ng
*Assistant Examiner*—Huyen D. Le
*Attorney, Agent, or Firm*—Fuller, Ryan, Hohenfeldt & Kees

[57] ABSTRACT

An acoustical transducer unit mountable in a speaker enclosure with a speaker opening adapted to face a user's ear, and a method for manufacturing the transducer. The transducer has a pair of opposing plates spaced apart a predetermined distance and a diaphragm physically connected and positioned between the plates, though electrically separated from the plates. The plates are adapted to be connected to an audio signal source, while the diaphragm receives a bias voltage. The transducer is mounted in the enclosure facing outward toward the speaker opening. The diaphragm is formed of a flexible substrate material such as MYLAR TM. A substantially infrared transparent material is deposited onto each side of the substrate in a thin layer to arrive at a transducer which is at a much higher level of performance than those of the prior art. The deposited material is infrared transparent so as to permit the deposition process to proceed without substantial damage or distortion to the diaphragm. Because the deposited metal is transparent to infrared energy, the diaphragm may be thinner than $5.0 \times 10$ meters, resulting in a transducer having substantially improved frequency response due to the thinness and low mass of the diaphragm.

9 Claims, 1 Drawing Sheet

ELECTROSTATIC ACOUSTIC TRANSDUCER HAVING EXTREMELY THIN DIAPHRAGM SUBSTRATE

CROSS REFERENCE TO RELATED APPLICATION

This application is a continuation-in-part of application Ser. No. 07/461,197, filed Jan. 5, 1990.

BACKGROUND OF THE INVENTION

This invention relates to acoustic transducers, for use such as in loudspeakers, headphones and microphones, and in particular to such acoustic transducers based upon electrostatic principles.

It is well known to produce an acoustic transducer based upon electrostatic principles. Generally, as shown in Lange, U.S. Pat. No. 3,362,903, an electrostatic acoustic transducer includes a pair of fixed electrodes, often with a multiplicity of small openings and supported opposite to each other, and with a vibrating film or diaphragm affixed therebetween. The diaphragm is caused to vibrate according to the desired acoustical frequencies by applying electrical fields to the electrodes, so as to faithfully reproduce an audio signal.

Often the material of the diaphragm is a polyethylene terephthalate film manufactured by DUPONT under the trademark MYLAR. As is well known, MYLAR TM has an extremely high sheet resistivity, on the order of about $10^{18}$ ohms per square, which causes the attendant electronic drive circuitry to be exceedingly complex and expensive It may be that a coating of a complex quaternary compound used in the fabric industry could be applied to a MYLAR TM diaphragm to reduce the resistivity. When such quaternary compounds are used, however, the sheet resistivity of the surface is dependent upon ambient humidity, and can change noticeably with small changes in humidity, adversely affecting the acoustical performance of any transducer of which it is a part. These changes based upon humidity are particularly noticeable if the acoustic transducer is used in a headphone speaker application, because of the increased humidity caused by the proximity of the transducer to the listener's head and ear.

As indicated in Atoji, U.S. Pat. No. 3,833,770, it is known to provide an electret, the electrostatic equivalent of a permanent magnet, with a conductive layer formed on one side thereof. Atoji proposes to have the electret generate an electrostatic field between itself and one of the fixed electrodes and thereby eliminate certain harmonics generated between the electret and the other fixed electrode. Thus, Atoji proposes to apply highly conductive materials such as aluminum or silver to one side of the diaphragm. This application of highly conductive materials to the diaphragm material, however, drastically reduces the sheet resistivity of the diaphragm, and adds significant mechanical mass to the diaphragm. The overall effect of these changes is to reduce the acoustic performance of the transducer, unless other changes are made in the design and construction of the transducer to maintain sound quality. Such changes to maintain sound quality again result in increased expense of manufacture.

This invention relates to improvements over the structures described above, and to solutions to some of the problems raised thereby.

SUMMARY OF THE INVENTION

The invention relates to an acoustical transducer unit such as could be mounted in an enclosure with a speaker opening adapted to face a user's ear, and a method of making same. According to the invention, the transducer has a pair of perforated opposing plates spaced apart a predetermined distance, and a diaphragm connected and positioned between the plates. The plates are electrically separate and adapted to be individually connected to an audio signal source. The transducer is mounted in the enclosure facing outward toward the speaker opening. The diaphragm is formed of a very thin, flexible substrate material, such as MYLAR TM, generally less than about $5.0\times10^{-6}$ meters thick. A layer of material having extremely high sheet resistivity, on the order of $10^7$ to $10^9$ ohms per square, is deposited onto each side of the substrate in a thin layer, on the order of about 300 Å to 700 Å. It is critical that the material having high sheet resistivity be substantially transparent to infrared energy, so as to permit the deposition process, and dissipate the heat generated thereby, to proceed without substantial damage or distortion to the diaphragm. The material that has been found to be most functional in this application is germanium.

Other objects and advantages of the invention will become apparent hereinafter

DESCRIPTION OF THE PREFERRED EMBODIMENT

Figure 1:
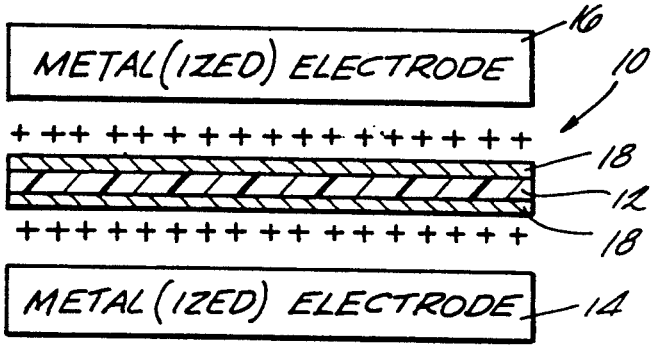
FIG. 1 is a schematic view of an acoustic transducer constructed according to a preferred embodiment of the invention.
Figure 2:
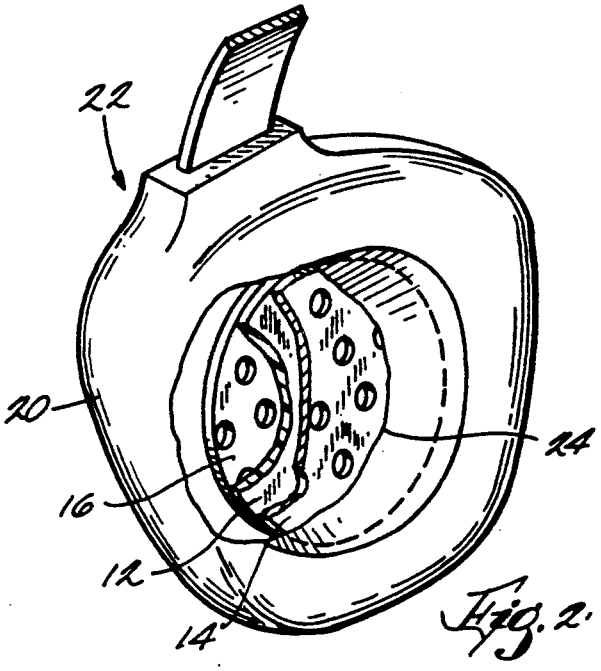
FIG. 2 is an isometric view, partially in section, of the acoustic transducer shown in FIG. 1 assembled into a headphone cup.

Referring now to FIGS. 1 and 2, t here is shown an acoustic transducer 10 constructed according to electrostatic principals and according to a preferred embodiment of the invention. As shown there, the transducer 10 includes a diaphragm substrate 12 constructed of a suitable material such as a polyethylene terephthalate film manufactured by DUPONT under the trade name MYLAR TM. This diaphragm substrate is affixed under tension between two metal or metallized plates 14 and 16 which act as electrodes. These plates 14 and 16 are generally spaced apart about 0.02 to about 0.03 inches, and preferably about 0.028 inches.

This diaphragm substrate material has an inherently extremely high sheet resistivity, on the order of about $10^{18}$ ohms per square. Applicants have determined that improved performance can be achieved by reducing this sheet resistivity slightly, to a level on the order of about $10^7$ to $10^9$ ohms per square. However, since the sheet resistivity of a particular material is not easily adjustable, some external means is required to effect the necessary change. In the past, as indicated in the Atoji patent referred to above, highly conductive materials such as aluminum and silver have been applied to the diaphragm. For the reasons set forth above relating to the Atoji patent, however, applicant has found that this application of conductive materials to the diaphragm had the overall effect of reducing the acoustic performance of the transducer rather than enhancing it, or disproportionately increasing the cost.

Another substantial disadvantage of the processes and structures in the prior art is the effect of the metal deposition process on the diaphragm substrate material itself If better frequency response is desired, one method of obtaining that effect is to reduce the mass of the diaphragm. Without changing the material, there is only one way to reduce the mass of a diaphragm of a predetermined area, and that is to reduce its thickness While references such as Yoshikawa et al, U.S. Pat. No. 4,049,859 disclose the deposition of "any metal capable of deposition", including aluminum, tin, zinc, chromium, nickel, copper, silver, gold, platinum or tungsten, applicants have found that deposition of these metals is practical only if the diaphragm substrate on which the metal is to be deposited is relatively thick, or if just one side is to receive the deposition. Once the thickness of a MYLAR TM diaphragm is reduced any substantial amount below $10^{-5}$ meters, such as to about $5.0\times10^{-6}$ meters or less, the process of depositing these most commonly used metals onto both sides of the diaphragm begins to adversely affect the performance of the resulting transducer.

This adverse effect comes about because, as it is well known, the process of deposition is heat intensive. With one of the metals listed in Yoshikawa already on the first side, the heat generated by the deposition on the second side is trapped within the substrate, and the substrate becomes distorted in shape, or even destroyed, by the deposition process.

According to the present invention, prior to affixing the diaphragm between the plates 14 and 16 as described above, employing the flexible diaphragm 12 as a substrate material, a material 18 having a high sheet resistivity is deposited onto each side of the substrate. The material 18 may be deposited by any suitable, repeatable and controllable means, such as by vacuum deposition.

It is critical that this deposited material 18 be substantially transparent to infrared energy. As just described, if the material is not substantially infrared transparent, once the material is deposited on the first side of the substrate, the deposition of the material on the second side will result in heat being trapped in the diaphragm material by the material already deposited on the first side, resulting in the distortion and potential destruction referred to just above.

Applicants have found that an infrared transparent material may be deposited onto a MYLAR TM substrate at least as thin as $1.5\times10^{-6}$ meters without adversely affecting the performance characteristics of the diaphragm, in fact resulting in a diaphragm with unprecedented performance because of its light weight and thinness, without distortion. Because the reason for depositing the material is to lower the sheet resistivity to a predetermined level, about $10^7$ to $10^9$ ohms per square, it would be preferable to deposit a thin layer of high sheet resistivity, lightweight material. Applicants have found that the most preferable such material is germanium.

A thin layer of infrared transparent material 18 deposited on both sides of the diaphragm-substrate, preferably on the order of about 300 Å to about 700 Å, results in a sheet resistivity of from about $10^{14}$ to about $5.5\times10^7$, ohms per square, depending upon the thickness of the material deposition. Within this range, assuming the material is germanium, applicant has found that the most preferable thickness of the deposited layer is about 500 Å, resulting in a sheet resistivity of about $10^7$ to $10^9$ ohms per square As shown in FIG. 2, this transducer 10 once constructed according to the method described above may be mounted to a headphone speaker unit 20 of a headphone set 22, facing toward a speaker opening 24 therein. The transducer 10 is then electrically connected in the headphone circuit, to arrive at the assembled headphone set 22.

While the method and apparatus hereinbefore described is effectively adapted to fulfill the aforesaid objects, it is to be understood that the invention is not intended to be limited to the specific preferred embodiment of electrostatic acoustic transducer set forth above. Rather, it is to be taken as including all reasonable equivalents within the scope of the following claims.

We claim:

1. An electrostatic acoustic transducer comprising:

a pair of spaced apart opposing plates; and a diaphragm connected and positioned between said plates, and spaced apart from each of said plates;

said diaphragm including a flexible substrate material of a thickness less than about $5.0\times10^{-6}$ meters, and a material transparent to infrared energy deposited onto each side of said substrate.

2. An electrostatic transducer as recited in claim 1 wherein said deposited material is a thin layer of a metal having a high sheet resistivity.

3. An electrostatic transducer as recited in claim 1 wherein said deposited material is germanium.

4. A headphone speaker unit comprising:

an enclosure with a speaker opening adapted to face a user's ear; and an electrostatic acoustic transducer having a pair of spaced apart opposing plates, and a diaphragm connected and positioned between said plates, and spaced apart from each of said plates, said plates being adapted to be connected to an audio signal source said transducer being mounted in the enclosure facing outward toward said speaker opening;

said diaphragm including a flexible substrate material the thickness of which substrate material being less than about $5.0\times10^{-6}$ meters, and a material transparent to infrared energy deposited onto each side of said substrate.

5. A headphone speaker unit as recited in claim 4 wherein said infrared transparent material is a thin layer of a metal having a high sheet resistivity.

6. A headphone speaker unit as recited in claim 4 wherein said infrared-transparent material is germanium.

7. A method of manufacturing an electrostatic acoustic transducer comprising:

providing a diaphragm substrate material having an extremely high sheet resistivity, the thickness of said substrate being less than about $5.0\times10^{-6}$ meters;

depositing a material transparent to infrared energy onto each side of said substrate, to thereby form a diaphragm;

affixing together a pair of opposing plates spaced apart a predetermined distance, with said diaphragm stretched therebetween and spaced apart from both plates.

8. A method as recited in claim 7 wherein the infrared transparent material provided for deposition is a thin layer of a metal having a high sheet resistivity.

9. A method as recited in claim 7 wherein the infrared transparent material provided for deposition is germanium.

* * * * *